US009895592B2

(12) United States Patent
Emard

(10) Patent No.: US 9,895,592 B2
(45) Date of Patent: Feb. 20, 2018

(54) FACE SHIELD FOR REDUCING FACIAL INJURIES

(71) Applicant: Richard Allen Emard, Temecula, CA (US)

(72) Inventor: Richard Allen Emard, Temecula, CA (US)

( * ) Notice: Subject to any disclaimer, the term of this patent is extended or adjusted under 35 U.S.C. 154(b) by 256 days.

(21) Appl. No.: 14/853,656

(22) Filed: Sep. 14, 2015

(65) Prior Publication Data

US 2016/0073710 A1 Mar. 17, 2016

Related U.S. Application Data

(60) Provisional application No. 62/051,073, filed on Sep. 16, 2014.

(51) Int. Cl.

| | |
|---|---|
| ***A63B 71/10*** | (2006.01) |
| ***A63B 71/08*** | (2006.01) |
| *A63B 71/06* | (2006.01) |
| *A63B 102/20* | (2015.01) |
| *A63B 102/18* | (2015.01) |

(52) U.S. Cl.

CPC ..... *A63B 71/10* (2013.01); *A63B 71/085* (2013.01); *A63B 71/0622* (2013.01); *A63B 2102/18* (2015.10); *A63B 2102/20* (2015.10); *A63B 2207/02* (2013.01); *A63B 2209/08* (2013.01); *A63B 2209/10* (2013.01); *A63B 2220/806* (2013.01)

(58) Field of Classification Search

CPC ... A63B 71/10; A63B 71/085; A63B 2102/18; A63B 2102/20; A63B 71/0622; A63B 2207/02; A63B 2209/08; A63B 2209/10; A63B 2220/806; A61F 9/029

USPC ..... 351/132

See application file for complete search history.

(56) References Cited

U.S. PATENT DOCUMENTS

| | | | | | |
|---|---|---|---|---|---|
| 4,856,089 | A | * | 8/1989 | Horton | A61F 9/025 2/10 |
| 4,877,320 | A | * | 10/1989 | Holden | A61F 9/02 351/44 |
| 4,944,039 | A | * | 7/1990 | Dietrich | A41D 13/11 2/13 |
| 4,955,394 | A | * | 9/1990 | Dean | A41D 13/1146 128/206.23 |
| 4,965,887 | A | * | 10/1990 | Paoluccio | A61F 9/02 128/201.25 |
| 5,220,689 | A | * | 6/1993 | Miller | A61F 9/029 2/12 |

(Continued)

*Primary Examiner* — William R Alexander

(74) *Attorney, Agent, or Firm* — Ariel S. Bentolila; Bay Area IP Group, LLC

(57) ABSTRACT

A baseball or softball protective facial mask worn like a pair of sunglasses or glasses without the inconvenience of straps. The protective facial mask having a protective frame assembly encompassing a wearer's face to reduce facial injuries. A set of ear extension components coupled to the protective frame assembly extend over or around a wearer's ears. The ear extension components having a non-slip silicon material to hold said protective facial mask in place to a wearer's head. A set of ear padding implements is disposed on an inner area of said ear extension components to dampen any force focused towards the wearer's ears. A nose bridge having a non-slip rubberized material helps support a weight of the protective facial mask.

20 Claims, 4 Drawing Sheets

(56) References Cited

U.S. PATENT DOCUMENTS 5,682,606 A * 11/1997 Pospisil ..... A41D 13/1184 2/173
5,790,230 A * 8/1998 Sved ..... A61F 9/025 351/110
6,012,164 A * 1/2000 Deal, III ..... A63B 71/10 2/9
6,374,424 B1 * 4/2002 Tredup ..... A41D 13/11 2/427
6,386,703 B1 * 5/2002 Huang ..... G02C 9/00 351/47
7,000,252 B1 2/2006 Tobin
7,055,951 B2 * 6/2006 Canavan ..... G02C 7/086 351/57
7,490,359 B2 * 2/2009 Landis ..... A41D 13/1184 128/857
7,934,497 B1 * 5/2011 Grove ..... A42B 3/288 128/201.19
8,011,026 B2 * 9/2011 Stevens ..... A42B 3/20 2/427
2002/0174480 A1 * 11/2002 Lombard ..... A42B 3/20 2/424
2007/0050895 A1 * 3/2007 Broersma ..... A61F 9/029 2/426
2007/0192946 A1 * 8/2007 Wright ..... A61F 9/045 2/424
2007/0252946 A1 * 11/2007 Welchel ..... A41D 13/1184 351/62
2008/0221241 A1 * 9/2008 Junk ..... C08L 69/00 524/100
2008/0313792 A1 * 12/2008 Pino ..... A42B 3/225 2/427
2009/0031484 A1 * 2/2009 Broersma ..... A42B 3/20 2/424
2010/0033674 A1 * 2/2010 Huang ..... G02C 5/143 351/123
2010/0095439 A1 * 4/2010 Nolan ..... A42B 3/24 2/421
2011/0145982 A1 * 6/2011 Fine ..... A61F 9/025 2/431
2011/0209273 A1 * 9/2011 Fountain ..... A61F 11/14 2/423
2012/0186004 A1 * 7/2012 Mechling ..... A42B 3/20 2/425
2013/0047322 A1 * 2/2013 Peebles ..... A63B 71/10 2/421
2013/0061372 A1 * 3/2013 Goldstein ..... A42B 3/20 2/411
2013/0139816 A1 * 6/2013 Proctor ..... A62B 18/02 128/204.15
2013/0326798 A1 * 12/2013 Clement ..... A42B 3/12 2/418
2014/0196200 A1 7/2014 Beliveau
2015/0033431 A1 * 2/2015 Hofer Kraner ..... A61F 9/067 2/8.8
2015/0290039 A1 * 10/2015 McCulloch ..... A61F 9/029 2/439

* cited by examiner

FACE SHIELD FOR REDUCING FACIAL INJURIES

CROSS-REFERENCE TO RELATED APPLICATIONS

The present Utility patent application claims priority benefit of the U.S. provisional application for patent Ser. No. 62/051,073 entitled "SUNGLASS STYLE BASEBALL/SOFTBALL PROTECTIVE FACE SHIELD", filed on 16 Sep. 2014 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

FIELD OF THE INVENTION

One or more embodiments of the invention generally relate to protective headgear. More particularly, the invention relates to protective facial masks.

BACKGROUND OF THE INVENTION

Protective headgear is often worn during sport activities to protect a wearer from face and/or head injuries. Wearers of protective headgear often wear headgear designed to block objects such as, but not limited to, sports balls from hitting vital areas such as a wearer's eyes, nose, and mouth. Typically, protective headgear may also be designed to reduce interference with a wearer's performance such as, but not limited to, unrestricted breathing, unobscured vision, and/or reduced headgear weight.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that some current headgear secure to a wearer's head by wrapping straps around a wearer's head and/or with a head cap worn on top of a wearer's head. Other typical designs protect a wearer's head and/or face with a wire mesh or a bulky face shield.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1A:
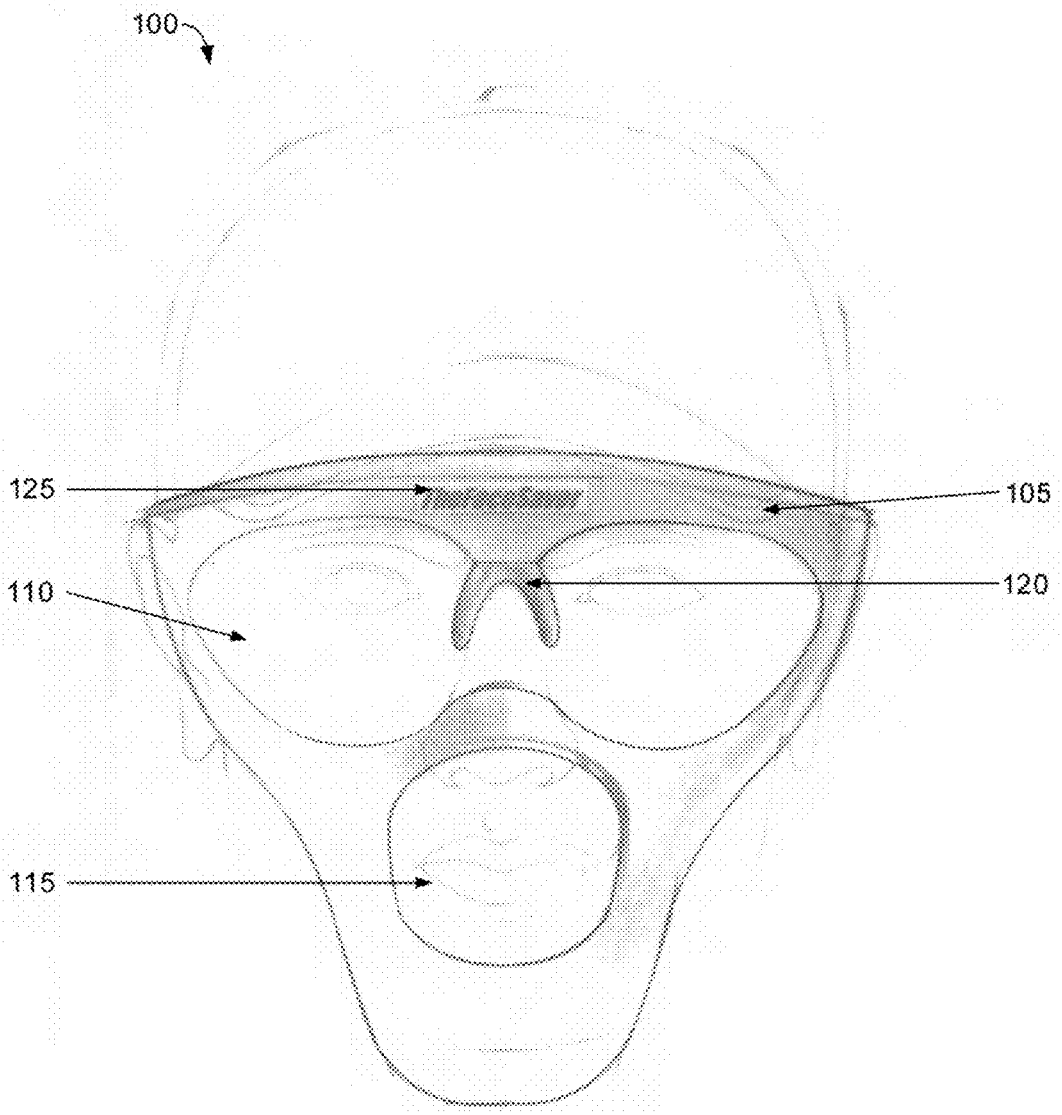
Fig. 1A illustrates a front view of an exemplary protective facial mask, in accordance with an embodiment of the present invention.

Unless otherwise indicated illustrations in the figure are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" limits the scope of a claim to the specified elements or method steps, plus those that do not materially affect the basis and novel characteristic(s) of the claimed subject matter. Moreover, for any claim of the present invention which claims an embodiment "consisting essentially of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limited in any ways. Depending on the needs of the particular application, those skilled in the art will readily recognize, in light of the following teachings, a multiplicity of suitable alternative implementation details.

Some embodiments of the present invention and variations thereof, relate to protective facial masks. In one embodiment of the invention, a protective facial mask may be designed with ear extensions.

FIG. 1A illustrates a front view of an exemplary protective facial mask 100, in accordance with an embodiment of the present invention. Protective facial mask 100 may comprise of a protective frame 105, an eye opening 110, a mouth opening 115, a nose bridge 120, and an advertisement space 125. Protective frame 105 may be made of protective materials such as, without limitation, polycarbonate, plastic, carbon fiber, graphite, aluminum, chrome, etc. and sized according to a wearer's head and/or facial structure. Eye opening 110 and mouth opening 115 may be sized such that objects such as, but not limited to, sports balls are blocked from passing through eye opening 110 and/or mouth opening 115 and hitting a wearer. Nose bridge 120 may be designed to support the weight of protective facial mask 100 and/or secure protective facial mask 100 to a wearer's head during use. Advertisements, designs, and/or logos may be placed in advertisement space 125 to promote a company and/or add improve protective facial mask 100's aesthetics.

Protective facial mask 100 may be designed to protect a wearer's facial area against trauma such as, but not limited to, projectile hits, blunt forces, impacts, that may result in eye, nose, mouth, chin, cheek and temple injuries. One or more modular shields may be applied over eye opening 110, mouth opening 115, and/or the entirety of protective frame 105. Additionally, protective facial mask 100 may cover only a wearer's face and leave the rest of a wearer's head available for wearing accessories such as, without limitation, hats, visors, earphones, adjustable strap, camera, sunglasses or eye shield.

During typical use, a wearer may put on protective facial mask 100 in a manner similar to putting on a pair glasses. Nose bridge 120 may be securely positioned over a wearer's nose and balance part or all of the weight of protective facial mask 100. Protective frame 105 further comprises of a pair of ear extensions which may further secure protective facial mask 100 to a wearer's head without the need for interfering components such as, without limitation, straps, buckles, fasteners clips, helmets being positioned on the sides, top, and/or back of a wearer's head.

It may be appreciated by a person with ordinary skill in the art that protective frame 105 may be virtually any design. In an alternative embodiment of the present invention, protective frame 105 may have a series of ridges cut such that the weight of protective facial mask 100 is reduced. In still another alternative embodiment of the present invention, certain designs may be etched into protective frame 105 to direct any forces away from structural weak points.

It may be appreciated by a person with ordinary skill in the art that protective frame 105 may be designed to allow for a wearer to wear other head and/or face accessories. In another embodiment of the present invention, protective frame 105 may protrude outwards to accommodate a wearer wearing glasses and/or mouth gear.

It may be appreciated by a person with ordinary skill in the art that eye opening 110 and/or mouth opening 115 may be partial openings. Eye opening 110 and/or mouth opening 115 may be partial openings such as, without limitation, a mesh, a grid of holes, a series of strips, or a material to help with breathing to keep out dust or pollen. In another embodiment of the present invention, eye opening 110 and mouth opening 115 may be slits cut into protective frame 105.

It may be appreciated by a person with ordinary skill in the art that nose bridge 120 may be modularly attached to protective facial mask 100. In another embodiment of the present invention, nose bridge 120 may be clipped onto protective frame 105.

It may be appreciated by a person with ordinary skill in the art that nose bridge 120 may be made from virtually any material and may be a different material from protective frame 105. Nose bridge 120 may be made from materials such as, without limitation, rubber, silicone, foam, lightweight polycarbonate, carbon fiber, nylon, or plastic. In another embodiment of the present invention, nose bridge 120 may be made from rubberized silicon to provide wearer comfort, ensure unobstructed breathing, and to improve the stability of protective facial mask 100.

It may be appreciated by a person with ordinary skill in the art that advertisement space 125 may be located anywhere and/or in any number on protective facial mask 100. In another embodiment of the current invention, advertisement space 125 may be a repeating design placed over the entire surface of protective facial mask 100.

It may be appreciated by a person with ordinary skill in the art that protective facial mask 100 may be virtually any shape and provide any amount of coverage of a wearer's head. Protective facial mask 100 may be, without limitation, encompass an entire wearer's head, cover the lower portion of a wearer's face, cover the upper portion of a wearer's face, cover the sides of the wearer's face. In another embodiment of the present invention, a protective facial mask 100 may only cover a wearer's mouth and chin to allow for a wearer to put on eye accessories such as goggles.

It may be appreciated by a person with ordinary skill in the art that peripherals may be mounted to protective facial mask 100. Peripherals may be mounted to protective frame 105 by mounting means such as, but not limited to, mounting rails, anchor points, and/or adhesives. Virtually any peripheral may be mounted to protective frame 105 such as, but not limited to, sun visors, flashlights, cameras, head up displays, and/or small electronics. In an alternative embodiment of the present invention, protective frame 105 may be designed with mounting rails along the sides of protective frame 105 and mounted with a camera to capture a wearer's activity.

It may be appreciated by a person with ordinary skill in the art that additional securing means may be implemented on protective facial mask 100. Securing means such as, but not limited to, ear clips, elastic bands, head tethers, etc. In another embodiment of the present invention, one or more additional straps may further secure a protective facial mask 100 to a wearer's head.

Figure 1B:
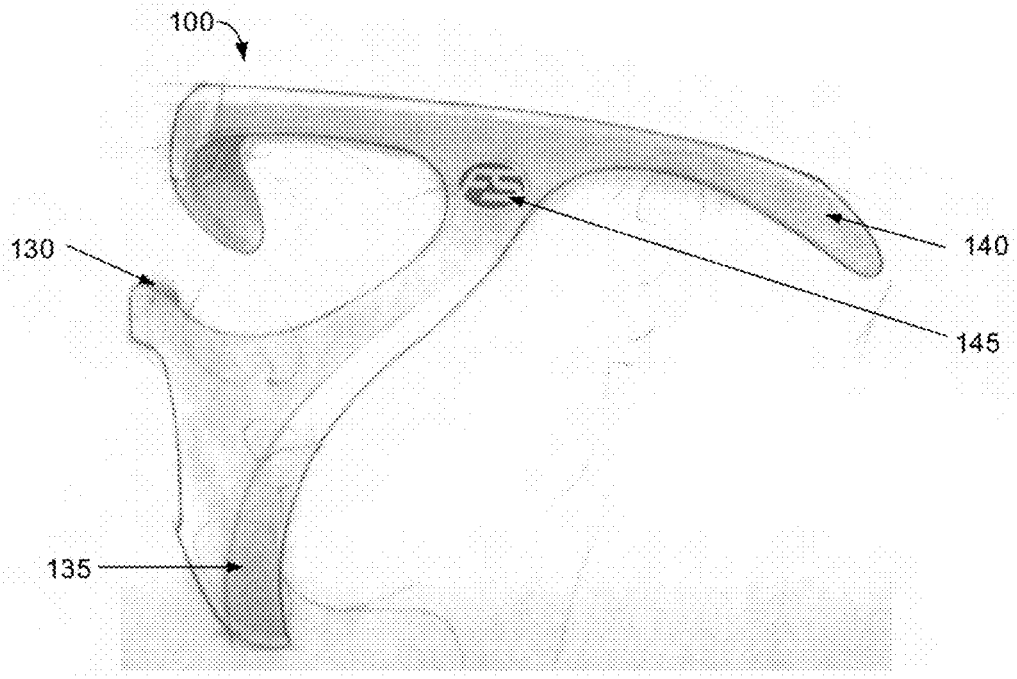
FIG. 1B illustrates a side view of an exemplary protective facial mask, in accordance with an embodiment of the present invention.

FIG. 1B illustrates a side view of an exemplary protective facial mask 100, in accordance with an embodiment of the present invention. Protective facial mask 100 may further comprise of a nose padding 130, a chin padding 135, a set of ear extensions 140, and an advertisement space 145. Nose padding 130 and/or chin padding 135 may be made from virtually any padding material such as, without limitation, foam, gel, leather, synthetic leather, etc. Additionally, nose padding 130 and/or chin padding 135 may be designed to dampen a majority of any force acted upon protective facial mask 100. A set of ear extensions 140 may extend over and/or around a wearer's ears such that protective facial mask 100 may be securely worn by a wearer. An advertisement space 145 may be any location that can accommodate an advertisement, design, and/or logo.

During typical use, a wearer places protective facial mask 100 over their face in a manner similar to wearing a pair of sunglasses. Ear extensions 140 are placed over a wearer's ear and may have an opening for one or more accessory straps to be fastened to protective facial mask 100. A nose bridge may further secure a protective facial mask 100 to a wearer's head.

It may be appreciated by a person with ordinary skill in the art that nose padding 130 and/or chin padding 135 may cover part or all of protective facial mask 100. In another embodiment of the present invention, nose padding 130 and chin padding 135 may cover all surfaces of protective facial mask 100 that a wearer comes in contact with.

It may be appreciated by a person with ordinary skill in the art that nose padding 130 and/or chin padding 135 do not necessarily need to be of uniform thickness. In another embodiment of the present invention, chin padding 135 may be thicker than padding in any other area of protective facial mask 100 in order to dampen any forces focused towards a wearer's chin.

It may be appreciated by a person with ordinary skill in the art that ear extensions 140 may be virtually any design. Ear extensions 140 may be, without limitation, circum-aural, supra-aural, intra-aural, over-the-ear, etc. In another embodiment of the present invention, ear extensions 140 may hinge around a wearer's ear. In an alternative embodiment of the present invention, ear extensions 140 may be ear cups worn over a wearer's ears. In still another alternative embodiment of the present invention, ear extensions 140 may be foam nubs that secure protective facial mask 100 to a wearer's temple area and/or forehead.

It may be appreciated by a person with ordinary skill in the art that advertisement space 145 may be located anywhere and/or in any number on protective facial mask 100. In another embodiment of the current invention, advertisement space 145 may be a repeating design placed over the entire surface of protective facial mask 100.

It may be appreciated by a person with ordinary skill in the art that protective facial mask 100 may not be one uniform piece. In an alternative embodiment of the present invention, protective facial mask 100 may have hinges allowing ear extensions 140 to fold inwards in a manner similar to eye glasses.

Figure 2:
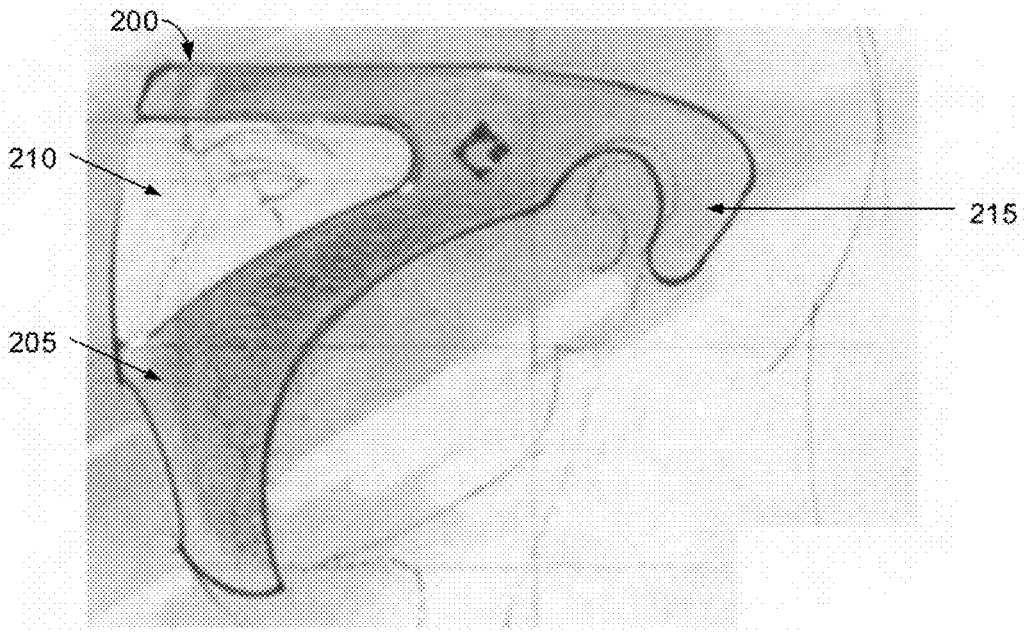
FIG. 2 illustrates an exemplary protective facial mask with removable shields, in accordance with an embodiment of the present invention.

FIG. 2 illustrates an exemplary protective facial mask 200 with removable shields, in accordance with an embodiment of the present invention. Protective facial mask 200 comprises of a protective frame 205, one or more shields 210, and a set of ear extensions 215. Protective frame 205 may have one or more openings such as, without limitation, eye openings, mouth openings, ventilation openings, artistic openings, etc. Openings in protective frame 205 may accommodate and secure one or more protective shields 210 by virtually any means such as, without limitation, magnets, Velcro, adhesives, interlocking ridges, etc. Shields 210 may be protective shields made from virtually any material such as, without limitation, glass, clear polycarbonate, plastic. Ear extensions 215 may be designed to secure protective facial mask 200 to a wearer's head.

It may be appreciated by a person with ordinary skill in the art that shields 210 may be made in virtually any design and/or material. Shields 210 may be, but not limited to, tinted lenses, wire meshes, nylon webbing. In another embodiment of the present invention, shields 210 may be tinted and polarized lenses to block any intense light directed towards a wearer. In an alternative embodiment of the present invention, shields 210 may be a heat resistant plastic to protect a wearer's face from intense flames. In still another alternative embodiment of the present invention, shields 210 may be a cloth filter to filter and/or catch any dust or sand particles from reaching a wearer's eyes and/or mouth.

It may be appreciated by a person with ordinary skill in the art that nearly any accessory may be fitted over an opening in protective frame 205. In an alternative embodiment of the present invention, an air filter may be fitted over a mouth opening in protective facial mask 200 to guard against airborne pathogens.

Figure 3:
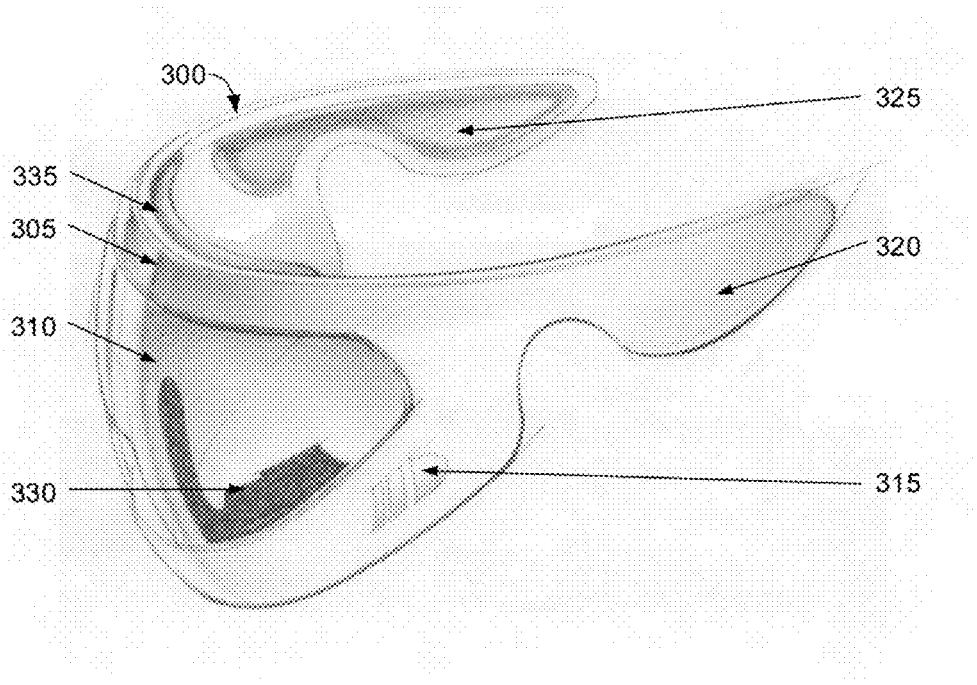
FIG. 3 illustrates an exemplary full face mask, in accordance with an embodiment of the present invention.

FIG. 3 illustrates an exemplary full face mask 300, in accordance with an embodiment of the present invention. Full face mask 300 comprises of a protective frame 305, a face shield 310, one or more air vents 315, a set of ear extensions 320, a set of ear padding 325, a chin padding 330, and a forehead padding 335. Protective frame 305 surrounds a wearer's face and allows for an unobstructed opening for a wearer's face. Face shield 310 may be secured over the opening in protective frame 305 by an attachment means such as, but not limited to, adhesives, Velcro, magnets, or snaps. One or more air vents 315 allow a wearer to easily breathe while wearing full face mask 300. Ear extensions 320 secure full face mask 300 to a wearer's head without impeding any accessories that may be worn on the top, back, and/or sides of a wearer's head. Ear padding 325, chin padding 330, and forehead padding 335 dampen any forces acted on protective frame 305 and further secure full face mask 300 to a wearer's head.

It may be appreciated by a person with ordinary skill in the art that face shield 310 may be made from virtually any material. Face shield 310 may be made from, without limitation, polycarbonate, fiberglass, plastic, or glass. In another embodiment of the present invention, face shield 310 may be made from a clear polycarbonate that does not obfuscate a wearer's vision.

It may be appreciated by a person with ordinary skill in the art that one or more air vents 315 may be located anywhere and/or in any number on full face mask 300. In another embodiment of the present invention, a series of air vents 315 may be located along the jawline of full face mask 300 to provide nearly unobstructed airflow to a wearer.

It may be appreciated by a person with ordinary skill in the art that ear padding 325, chin padding 330, and forehead padding 335 may be made from virtually any material. Ear padding 325, chin padding 330, and forehead padding 335 may be made from, without limitation, foam, gel, silicon, leather, synthetic leather. In an alternative embodiment of the present invention, ear padding 325, chin padding 330, and forehead padding 335 may be made from refillable air pockets to allow a wearer to adjust the fit of full face mask 300.

It may be appreciated by a person with ordinary skill in the art that ear padding 325, chin padding 330, and forehead padding 335 may be located virtually anywhere on full face mask 300. In another embodiment of the present invention, face shield 310 may have additional padding to dampen any forces acted over a wearer's face.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112 (6) when such corresponding structures are not explicitly disclosed in the foregoing patent specification. Therefore, for any invention element(s)/structure(s) corresponding to functional claim limitation(s), in the below claims interpreted under 35 USC § 112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing protective facial masks according to the present invention will be apparent to those skilled in the art. Various aspects of the invention have been described above by way of illustration, and the specific embodiments disclosed are not intended to limit the invention to the particular forms disclosed. The particular implementation of the protective facial masks may vary depending upon the particular context or application. By way of example, and not limitation, the protective facial masks described in the foregoing were principally directed to athletic protective gear implementations; however, similar techniques may instead be applied to motorcycle headgear, combat headgear, construction headgear, and firefighting headgear, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A baseball or softball protective facial mask worn like a pair of sunglasses or glasses without straps, the protective facial mask comprising:

a protective frame assembly encompassing a wearer's face, said protective frame assembly comprising at least one of an eye and mouth opening section, said opening section having a dimension configured to prevent a ball to penetrate through said openings;

a set of ear extension components coupled to said protective frame assembly, said ear extension components being configured to substantially extend over or around a wearer's ears, said ear extension components comprising a non-slip silicon material configured to hold said protective facial mask in place to a wearer's head;

a set of ear padding implements disposed on an inner area of said ear extension components, said set of ear padding being configured to dampen any force focused towards the wearer's ears;

a nose bridge being configured to support a weight of said protective facial mask, said nose bridge comprising a non-slip rubberized material configured to secure the protective facial mask to the wearer's head;

a nose padding being configured to dampen a majority of any force acted upon the wearer's nose, said nose padding comprising a lightweight polycarbonate material configured to allow for easy breathing; and a chin padding being configured to be thicker than padding in any other area of said protective facial mask in order to dampen any forces focused towards a wearer's chin.

2. The protective facial mask of claim 1, further comprising a protective frame with a series of ridges cut, said series of ridges cut is configured to reduce the weight of said protective facial mask.

3. The protective facial mask of claim 1, said ear extensions further comprising foam nubs configured to secure the protective facial mask to a wearer's temple area or forehead.

4. The protective facial mask of claim 1, said ear extensions further comprising a hinge around a wearer's ear.

5. The protective mask of claim 1, further comprising etched designs into said protective frame configure to direct any forces away from structural weak points of said protective frame.

6. The protective facial mask of claim 1, said eye opening comprising a clear polycarbonate material being configured to block a ball from passing through the eye opening and hitting a wearer.

7. The protective facial mask of claim 1, said mouth opening comprising a clear polycarbonate material being configured to block a ball from passing through the mouth opening and hitting a wearer.

8. The protective facial mask of claim 1, said protective frame is further configured to protrude outwards to accommodate a wearer wearing glasses or mouth gear.

9. The protective facial mask of claim 1, said eye opening or mouth opening may be partial openings comprising at least one of a mesh, a grid of holes, a series of strips, and a material to help with breathing or to keep out dust or pollen.

10. The protective facial mask of claim 1, said eye opening and mouth opening comprising slits cut into said protective frame section.

11. The protective facial mask of claim 1, said nose bridge is configured to be clipped onto said protective frame.

12. The protective facial mask of claim 1, said nose bridge non-slip rubberized material comprises a rubberized silicon to provide wearer comfort, ensure unobstructed breathing, and to improve the stability of protective facial mask.

13. The protective facial mask of claim 1, said advertisement space comprises a repeating design placed over the entire surface of said protective facial mask.

14. The protective facial mask of claim 1, said openings in said protective frame comprising at least a protective shield secured by interlocking ridges to said protective frame.

15. The protective facial mask of claim 14, said protective shield comprises at least one of a glass and clear polycarbonate.

16. The protective facial mask of claim 14, said protective shield comprises at least one of a tinted lens, wire mesh, and nylon webbing.

17. The protective facial mask of claim 14, said protective shield comprises at least a tinted and polarized lens to block any intense light directed towards a wearer.

18. The protective facial mask of claim 14, said protective shield comprises at least one of a heat resistant plastic to protect a wearer's face from intense flames.

19. A face shield consisting essentially of:

means for securing said face shield over or around a wearer's ears;

means for dampening a force focused towards the wearer's ears, wherein said dampening means comprises at least a set of ear padding implements disposed on an inner area of a plurality of ear extension components of said face shield;

means for supporting a weight of said face shield, wherein said weight supporting means comprises a nose bridge having a non-slip rubberized material configured to secure the protective facial mask to the wearer's head;

means for allowing the wearer to easily breathe while wearing said face shield, wherein said easy breathing allowing means comprises at least a nose padding having a lightweight polycarbonate material configured to allow for easy breathing;

means for dampening a majority of forces acted upon said protective facial mask; and means, being configured to be thicker than padding in any other area of said protective facial mask, for dampening any force focused towards the wearer's chin.

20. A face shield comprising:

a protective frame section encompassing a wearer's face, said protective frame section comprising an eye opening, said opening having a dimension configured to prevent a ball to penetrate through said opening;

a set of ear extension components coupled to said protective frame, said ear extension components being configured to substantially extend over or around a wearer's ears, said ear extensions comprising a non-slip silicon material configured to hold said protective facial mask in place to a wearer's head;

a set of ear padding implements disposed on an inner area of said ear extensions, said set of ear padding being configured to dampen any force focused towards the wearer's ears;

a nose bridge segment being configured to support a weight of said protective facial mask, said nose bridge comprising a non-slip rubberized material configured to secure the protective facial mask to the wearer's head;

a nose padding implement being configured to dampen a majority of any force acted upon the wearer's nose, said nose padding comprising a lightweight polycarbonate material configured to allow for easy breathing;

an air vent constituent, said air vent constituent comprising at least two or more air vents configured to allow a wearer to easily breathe while wearing said face shield;

a chin padding implement being configured to be thicker than padding in any other area of said protective facial mask in order to dampen any forces focused towards a wearer's chin; and a forehead padding component being configured to dampen a majority of any force acted upon the wearer's nose or forehead.

* * * * *